United States Patent [19]

Crist

[11] Patent Number: 5,020,723

[45] Date of Patent: Jun. 4, 1991

[54] HOT MELT GLUE SPRAYING DEVICE

[76] Inventor: Lawrence E. Crist, 3517 Jefferson Township Pkwy., Marietta, Ga. 30066

[21] Appl. No.: 391,871

[22] Filed: Aug. 10, 1989

[51] Int. Cl.[5] ..... B05B 17/04; B05B 1/24; B05B 7/10

[52] U.S. Cl. ..... 239/11; 239/133; 239/292; 239/405; 264/12

[58] Field of Search ..... 239/11, 13, 133, 135, 239/399, 405, 406, 290, 292, 450, 137; 264/12; 425/7, 10

[56] References Cited

U.S. PATENT DOCUMENTS

| | | | |
|---|---|---|---|
| 2,743,963 | 5/1956 | Peeps | 239/290 |
| 3,408,007 | 10/1968 | Raichle et al. | 239/133 |
| 4,021,167 | 5/1977 | Niimi et al. | 425/10 |
| 4,335,677 | 6/1982 | Nagata et al. | 239/406 |
| 4,631,013 | 12/1986 | Miller | 264/12 |
| 4,642,262 | 2/1987 | Piotrowski et al. | 264/12 |
| 4,669,660 | 6/1987 | Weber et al. . | |
| 4,669,661 | 6/1987 | Otto . | |
| 4,815,660 | 3/1989 | Boger . | |

FOREIGN PATENT DOCUMENTS

| | | | |
|---|---|---|---|
| 8001123 | 9/1981 | Netherlands | 239/133 |

OTHER PUBLICATIONS

O.G. Notice for Patent No. 4,175,702 to Hetherington.
O.G. Notice for Patent No. 4,130,247 to Healy.
O.G. Notice for Patent No. 4,082,223 to Nozawa.
O.G. Notice for Patent No. 4,013,225 to Davis.
O.G. Notice for Patent No. 3,820,722 to Jett.
O.G. Notice for Patent No. 3,820,721 to Hellenkamp.
"Hot Melt Spray for All Applications," *Nonwovens Industry,* May 1985, (p. 96).
"Mercer 'NO CHAR' Hot Melt Systems," *Nonwovens Industry,* Feb. 1986, (p. 40).
"Nordson Applying New Technology to Nonwovens," *Nonwovens Industry,* Dec. 1987, (p. 39).

*Primary Examiner*—Andres Kashnikow
*Assistant Examiner*—Christopher G. Trainor
*Attorney, Agent, or Firm*—Kilpatrick & Cody

[57] ABSTRACT

A device and method for spraying hot melt glue in circular patterns of varying diameters is disclosed. The device uses a single jet of pressurized air caused to spin and forced into a series of passages to produce a conical curtain of air. The conical air curtain impinges upon a stream of hot adhesive to spin and guide it on a surface in a circular pattern. The relative positions of the air and glue emission orifices may be adjusted quickly and easily to provide fine control of the spray pattern diameter while achieving patterns having diameters ranging from approximately one-half to fifteen inches. Spiral glue patterns may be created merely by moving the nozzle of the device relative to a surface in a substantially straight line.

10 Claims, 2 Drawing Sheets

HOT MELT GLUE SPRAYING DEVICE

This invention relates to devices for spraying hot melt (thermoplastic) glue in circular and spiral patterns of varying diameters.

BACKGROUND OF THE INVENTION

Hot melt glue sprayers are used in a number of industries to provide adhesives for bonding various materials. The sprayers, typically hand-held or fixed guns which evolved from similar devices used for applying paint, lacquer, and other coatings to furniture, automobiles, and a variety of other surfaces, are fed with heated, pressurized glue through electrically heated lines and with jets of air used to direct the glue in a particular pattern. Existing sprayers are capable of producing circular or spiral patterns of approximately three inches in diameter. Such sprayers are not adjustable with great precision, however, and cannot produce the wide diameter patterns needed for certain applications in, for example, the non-wovens industry.

SUMMARY OF THE INVENTION

The hot melt glue sprayer of the present invention produces a spray adjustable from approximately one-half to fifteen inches in diameter. The sprayer utilizes a single air inlet appropriately positioned at the rear portion of a nozzle assembly to produce a spinning stream of air. The spinning stream then is forced into a passage having a hexagonally-shaped interior boundary and a circular exterior boundary which restricts the flow of spinning air, causing angular, spiral movement at increased velocity and creates a second, spinning boundary layer. The layers subsequently are remixed and a cone of pressurized air emitted from the nozzle assembly. The air cone, aimed at the adhesive stream likewise emitted from the nozzle assembly, spins the adhesive stream upon impact to guide it onto a bonding surface in a circular pattern. Components within the nozzle assembly are adjustably positionable to alter the air emission orifice and the angle of impingement upon the glue stream to provide adhesive patterns of differing diameters. Altering the relative pressures of the glue and air streams being fed to the nozzle provide additional means of controlling the dimensions and characteristics of the resulting pattern.

It is therefore an object of the present invention to provide a finely adjustable hot melt glue sprayer capable of spraying adhesive in a circular pattern having a diameter variable over a wide range.

It is an additional object of the present invention to provide a hot melt glue sprayer having a single air inlet positioned at the rear of a nozzle assembly for producing a spinning stream of pressurized air.

It is another object of the present invention to provide a hot melt glue sprayer having a series of passages for producing angular, spiral movement of the spinning air at increased velocity and remixing it with a boundary layer of spinning air to form a cone of pressurized air.

Other objects, features, and advantages of the present invention will become apparent with reference to the remainder of the written portion and the drawings of this invention.

DETAILED DESCRIPTION OF THE DRAWINGS

Figure 1:
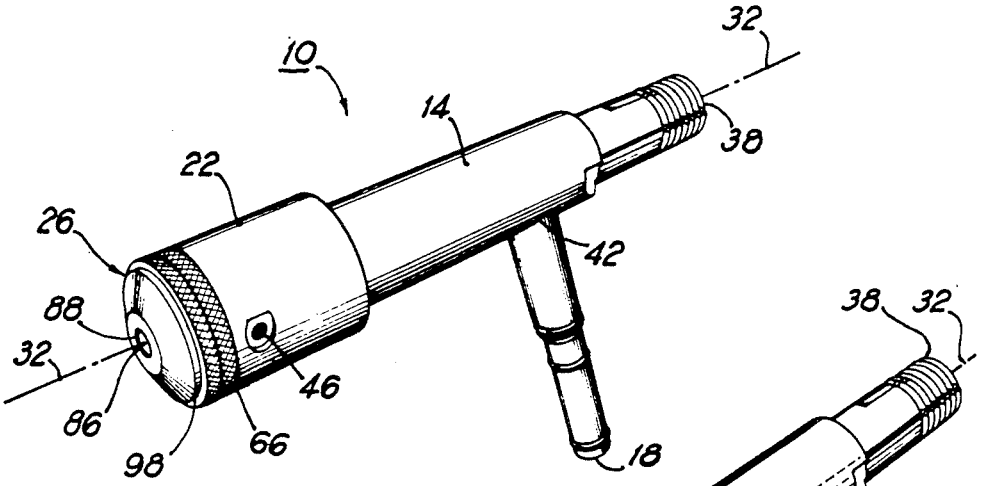
FIG. 1 is a perspective view of the sprayer apparatus of the present invention.
Figure 2:
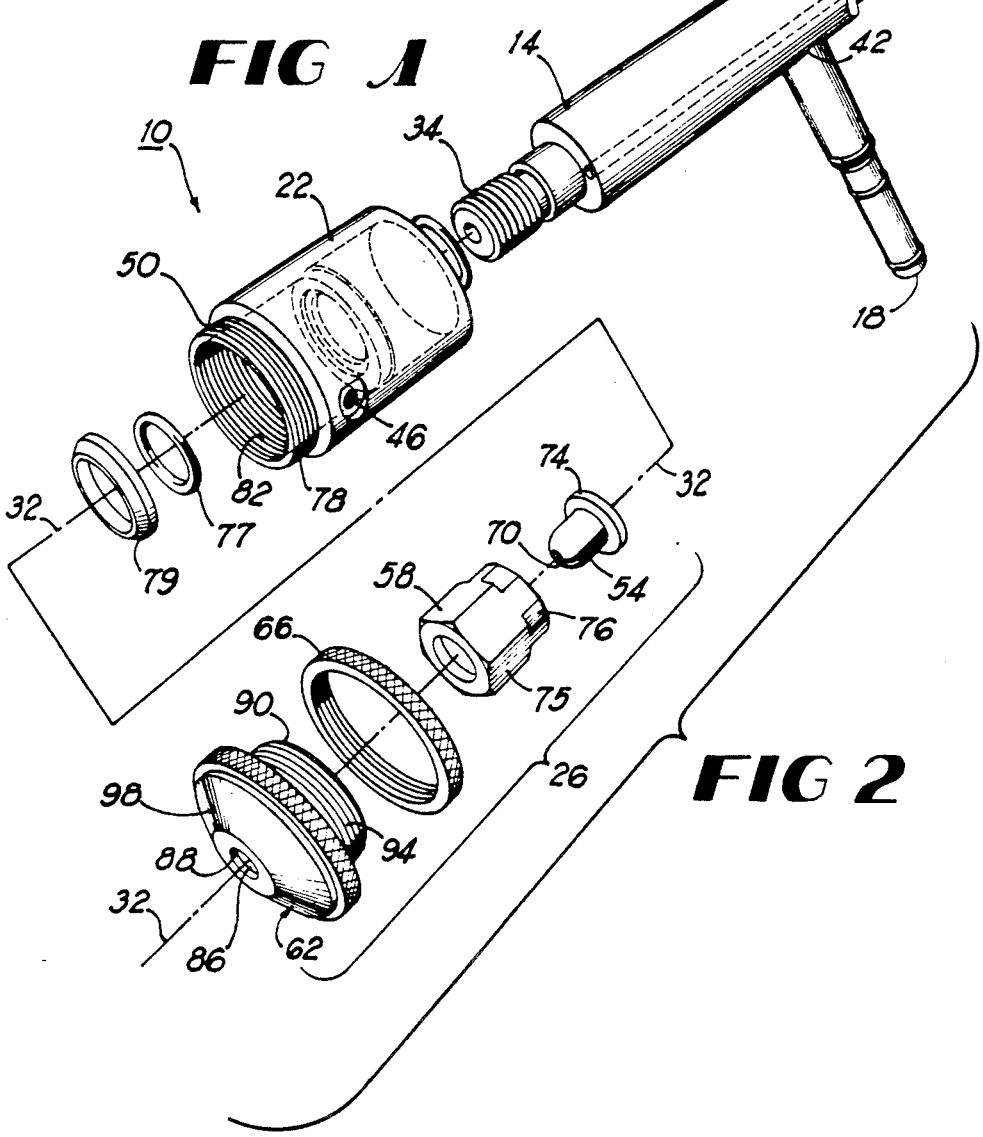
FIG. 2 is an exploded perspective view of the sprayer apparatus of FIG. 1.
Figure 3:
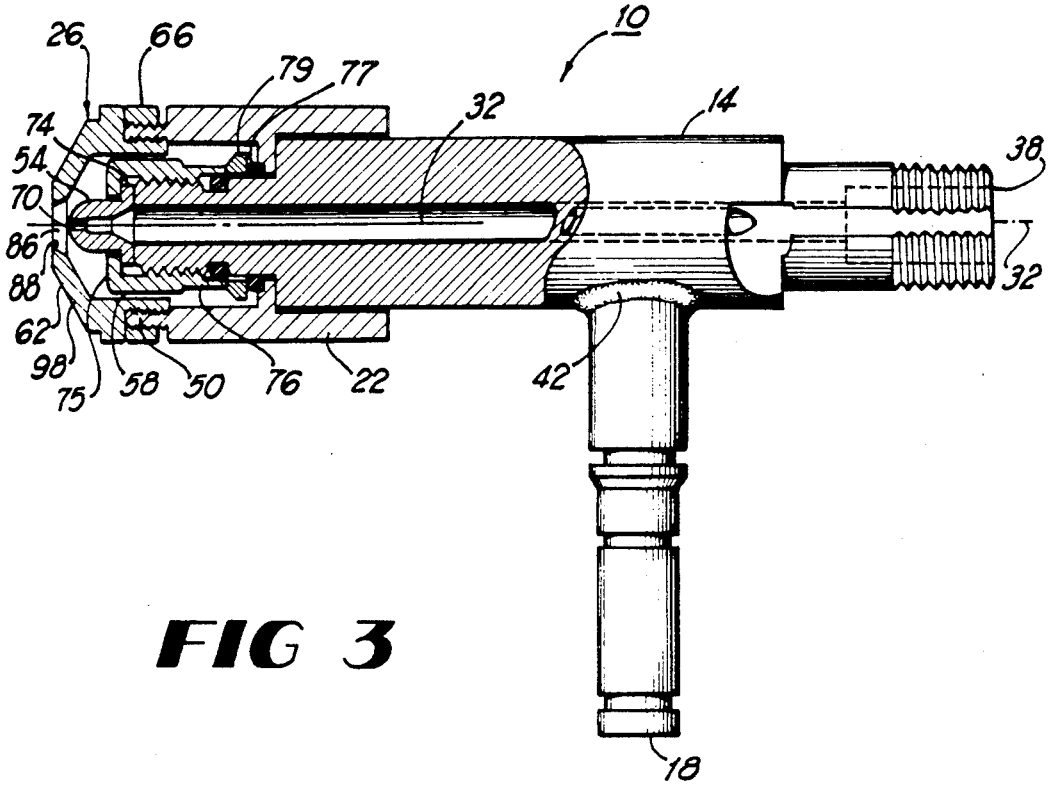
FIG. 3 is side elevational view of the sprayer apparatus of FIG. 2 with a portion shown in cross-section.

FIGS. 1–3 detail the sprayer apparatus 10 of the present invention. Sprayer 10 comprises four main structural elements, including a housing or heater body 14, an adhesive inlet 18, a spin chamber 22, and a nozzle assembly 26. Heater body 14 typically is a tubular piece of metal having a longitudinal axis 32 and threaded openings on both its front and rear ends 34 and 38, respectively. Heater body 14 also includes an opening 42 between ends 34 and 38 through which adhesive may be introduced and, in a preferred embodiment, is connected (by welding or otherwise) to the adhesive inlet tube or nipple 18 at opening 42. Spin chamber 22, a tubular section, surrounds the portion of heater body 14 nearest end 34 and itself includes a recessed, threaded opening 46 which serves as an air inlet for ultimately directing and shaping the stream of glue. In accordance with the present invention, opening 46 is not cut perpendicular to the surface of chamber 22, but rather is angled away from 90° to allow the air stream to enter the sprayer apparatus 10 above the longitudinal axis 32 and provide the appropriate air stream geometry as is further described below. As will be recognized by those skilled in the art, opening 46 alternatively may be cut to allow the air stream to enter the sprayer apparatus 10 below longitudinal axis 32. The end of spin chamber 22 adjacent nozzle assembly 26 has a reduced diameter opening 50.

Nozzle assembly 26 includes nozzle 54, nozzle retainer 58, air cap 62, and lock nut 66. Nozzle 54 has an orifice 70 and a flanged base 74 and fits within and is captured by nozzle retainer 58 so that the orifice 70 extends beyond the forward edge of the retainer 58. Nozzle retainer 58 consists of two segments, a first, hexagonally-shaped segment 75 and a second, substantially round segment 76. In a preferred embodiment first and second nozzle retainer segments 75 and 76 are integrally formed by machining a portion of a conventional hexagonal sheath to produce the second segment 76. Nozzle retainer 58 is threaded onto the front end 34 of heater body 14, thereby allowing orifice 70 to communicate with the tubular interior of heater body 14 and second nozzle retainer segment 76 to be aligned longitudinally with opening 46. Washer 77 and spacer 79 may be used to ensure appropriate placement of nozzle retainer 58.

As shown in FIGS. 1–3, lock nut 66 is positioned on the exterior threads 78 of heater cover opening 50, while air cap 62 is threaded onto the interior threads 82 of the same opening 50. Air cap 62 also contains an opening 86 aligned with orifice 70 of nozzle 54 and longitudinal axis 32. Orifice 70 of nozzle 54 fits substantially flush with opening 86 of air cap 62, leaving only a concentric ring-like area 88 of opening 86 through which air may exit. Because air cap 62 and lock nut 66 have differential threads, however, the longitudinal position of air cap opening 86 relative to nozzle orifice 70 may be adjusted (approximately ninety-thousandths of an inch in a preferred embodiment) to control the angle air impinges upon the adhesive stream as discussed below. Air cap 62 consists of two integrated portions, one tubular in shape (90) and containing threads 94 which mate with threads 82, and the other substantially conical in shape (98), with opening 86 serving as the apex of the cone. As best seen in FIG. 3, the surface defining air cap opening 86 is angled relative to longitudinal axis 32, providing additional means for determining and controlling the air impingement geometry.

A needle (not shown) may be spring-loaded into the tubular interior of heater body 14. With the needle in the retracted position, a pressurized and heated stream of glue may flow through adhesive inlet 18, into the interior of heater body 14, and out through orifice 70 and air cap opening 86 onto the surface to be bonded. To stop the stream of glue one need merely release the retracted needle, thereby allowing it to block or plug inlet 18 and orifice 70.

Once a stream of glue is established through inlet 18, a single stream of pressurized air is allowed to enter spin chamber 22 through inlet 46 above longitudinal axis 32 at an acute angle relative to an imaginary line drawn tangent to the spin chamber 22 surface at inlet 46. The air stream impinges upon the second round segment 76 of nozzle retainer 58 and initially is confined between that surface and the curved interior of spin chamber 22 to create its spinning motion. As additional air enters through inlet 46 the stream is forced into the passage defined by the first hexagonal segment 75 of nozzle retainer 58 and the curved interior of the tubular portion 90 of air cap 62, which restricts the flow of spinning air and imparts angular movement and increased velocity to the resulting air jets. Because the outermost surfaces of first hexagonal segment 75 do not abut the interior of tubular portion 90, a boundary layer of spinning air also exists in this passage.

Figure 4:
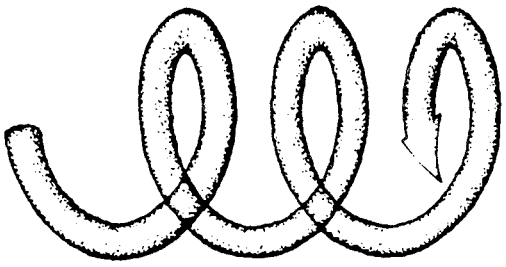
FIG. 4 is an example of a spray pattern produced using the sprayer apparatus of FIG. 1.

As the air reaches the substantially conical-shaped portion 98 of air cap 62 it is remixed in a tightening spiral pattern and approaches air cap opening 86 at the apex of the conical portion 98. The air thus ejected through ring-like opening 88 forms a cone-shaped curtain of moving air aimed at the glue stream exiting nozzle orifice 70 in which molecules of air move at an angle relative to the longitudinal axis 32. As the air cone impinges upon the glue stream it imparts a spinning motion to the adhesive, thereby allowing a circular glue pattern to be created upon a surface. One need merely move sprayer apparatus 10 in a substantially straight line relative to a surface to obtain a spiral pattern of adhesive (FIG. 4). Moreover, by repositioning lock nut 66 and air cap 62 relative to nozzle orifice 70, the angle at which the air cone impinges upon the adhesive stream may be altered quickly and easily to vary the diameter of the resulting circular (or spiral) glue pattern. In a preferred embodiment spray patterns having diameters between approximately one-half and fifteen inches may be achieved with fine control. Additionally, the dimensions and characteristics of the pattern may be altered by adjusting the relative pressures of the glue and air streams being fed to the sprayer 10.

Although not described herein in detail, conventional heating and transport means such as an electrical heater and conduit may be used to provide heated glue to adhesive inlet tube 18. Any source of compressed air may be used to supply air to air inlet 46 and advance or retract a conventional piston assembly against the spring-loaded needle. Additional discussion of conventional accessories used in conjunction with hot melt glue sprayers may be found in Otto U.S. Pat. No. 4,669,661, which patent is incorporated herein in its entirety by reference.

The foregoing is provided for purposes of illustration, explanation, and description of a preferred embodiment of the invention. Modifications and adaptations to this embodiment will be apparent to those of ordinary skill in the art and may be made without departing from the scope or spirit of the invention.

I claim:

1. A method for spraying adhesive, comprising the steps of:

a. providing a pressurized stream of thermoplastic adhesive to a nozzle received by a nozzle retainer having a hexagonal segment and a substantially circular segment, each segment having an exterior surface;

b. impacting the exterior surface of the substantially circular segment with pressurized air;

c. forcing the air into a first passage having an interior boundary defined by the hexagonal segment and an exterior boundary defined by a tubular surface, thereby imparting angular, spiral motion to the air;

d. forcing the air into a second passage having a substantialy conical exterior boundary; and e. emitting the air and adhesive through a common orifice so that the air will impinge upon the adhesive.

2. A method according to claim 1 in which the step of impacting the exterior surface of the substantially circular segment with pressurized air occurs at an angle of other than 90° to the surface of the segment at the point of impact, for causing the pressurized air to spin.

3. A device for spraying adhesive, comprising:

a. a housing having exterior and interior surfaces, an inlet through which adhesive may enter, and an opening through which adhesive may pass;

b. a nozzle assembly connected to the housing comprising:

i an inlet through which pressurized air may enter;

ii a nozzle communicating with the housing opening for emitting adhesive to be sprayed;

iii an air cap having an opening aligned with the nozzle through which the pressurized air and adhesive may pass; and iv means, defining a first passageway, for causing the pressurized air to spin; and c. a second passageway communicating with the first passageway and having a polygonal interior boundary and a circular boundary, for imparting angular, spiral movement to the spinning air.

4. A device according to claim 3 in which the first passageway defined by the spin causing means has substantially circular interior and exterior boundaries into which the pressurized air is forced.

5. A device according to claim 4 in which the interior boundary of the second passageway has a hexagonal shape.

6. A device according to claim 5 further comprising a third passageway having a substantially conical exterior boundary into which the air exiting the second passageway is forced, for mixing the exiting air.

7. A device according to claim 3 in which the air cap opening is adjustably positionable relative to the nozzle.

8. A device for spraying adhesive, comprising:

a. a housing having an inlet integrally formed therewith through which adhesive may enter, a longitudinal axis, and an opening along the longitudinal axis for receiving a retractable needle;

b. a nozzle assembly removably attached to the housing, comprising:

i. a nozzle communicating, with the housing opening for emitting adhesive to be sprayed;

ii. a nozzle retainer for receiving the nozzle, comprising:

A. a hexagonal segment;

B. a substantially circular segment integrally formed with the hexagonal segment and having an exterior surface; and C. an opening through which the nozzle protrudes; and iii. an aircap having integrally formed substantially circular and conical interior regions and an opening having a center defining the apex of the substantially conical region;

c. a cover surrounding a portion of the housing and to which the air cap may be attached, the cover having a threaded opening for receiving pressurized air to impinge upon the exterior surface of the substantially circular segment of the nozzle retainer at an angle other than 90° to the surface of the segment at the point of impingement for causing the air to spin; and in which the cover and the hexagonal segment of the nozzle retainer define a passage for imparting spiral movement to the spinning air.

9. A device according to claim 8 further comprising a means connectable to the cover for adjustably positioning the air cap opening relative to the nozzle.

10. A device according to claim 9 in which the positioning means is a lock nut.

* * * * *